US005147054A

United States Patent [19]

Pehr

[11] Patent Number: 5,147,054

[45] Date of Patent: Sep. 15, 1992

[54] TAMPER-PROOF CONTAINER

[76] Inventor: Harold T. Pehr, 3920 W. 96th St., Overland Park, Kans. 66207

[21] Appl. No.: 702,897

[22] Filed: May 20, 1991

[51] Int. Cl.[5] ..... B65D 41/00

[52] U.S. Cl. ..... 215/253; 215/232; 215/237; 215/251; 215/321

[58] Field of Search ..... 215/232, 235, 237, 251, 215/253, 321; 220/266, 268, 359

[56] References Cited

U.S. PATENT DOCUMENTS

| | | | |
|---|---|---|---|
| 4,640,427 | 2/1987 | Marino et al. | 215/232 |
| 4,795,044 | 1/1989 | Beck | 215/237 |
| 4,807,769 | 2/1989 | Gach | 215/235 |
| 4,865,216 | 9/1989 | Landis | 220/270 |
| 4,869,399 | 9/1989 | Dubach | 222/83 |
| 4,871,077 | 10/1989 | Ogden et al. | 215/366 |
| 4,881,656 | 11/1989 | Chumley | 220/270 |
| 4,892,217 | 1/1990 | Shastal | 220/258 |
| 4,921,113 | 5/1990 | Dubach | 215/253 |
| 4,934,556 | 6/1990 | Kleissendorf | 220/269 |
| 4,941,592 | 7/1990 | Kitterman | 222/23 |
| 4,942,977 | 7/1990 | Hidding | 220/276 |
| 4,948,003 | 8/1990 | Munoz | 215/237 |
| 4,960,216 | 10/1990 | Giles et al. | 215/232 |
| 4,969,574 | 11/1990 | Shastal | 220/269 |
| 4,971,218 | 11/1990 | Buchner et al. | 220/271 |
| 4,974,735 | 12/1990 | Newell et al. | 215/253 |
| 4,984,700 | 1/1991 | Knickerbocker | 215/251 |
| 4,984,716 | 1/1991 | Beck | 222/153 |
| 4,988,012 | 1/1991 | Shastal | 220/258 |
| 5,012,940 | 5/1991 | Koehn | 215/230 |

*Primary Examiner*—Stephen Marcus
*Assistant Examiner*—Nova Stucker
*Attorney, Agent, or Firm*—Litman, McMahon & Brown

[57] ABSTRACT

A tamper-proof container for over-the-counter drugs or the like includes a cylindrical plastic bottle which tapers to a narrow neck. An annular angled depression is molded into the bottle neck. A two-part closure includes a cap ring onto which is molded an annular angled projection sized and positioned to mate with the angled depression in the bottle neck when the cap ring is snapped over the bottle mouth. A hinged cap is attached to the cap ring and has a plurality of tamper tab projections connected thereto via a like plurality of frangible tear regions. The tamper tab projections mate with corresponding tamper tab depressions in the cap ring when the hinged cap is closed. After the bottle is filled, a tamper-evident seal is adhered over the mouth of the bottle and the cap ring is snapped over the bottle mouth, enclosing the tamper-evident seal. The cap ring is then ultrasonically welded to the bottle neck and the cap is ultrasonically welded to the cap ring via the tamper tabs. The result is a tamper-proof container.

15 Claims, 2 Drawing Sheets

Fig. 5.
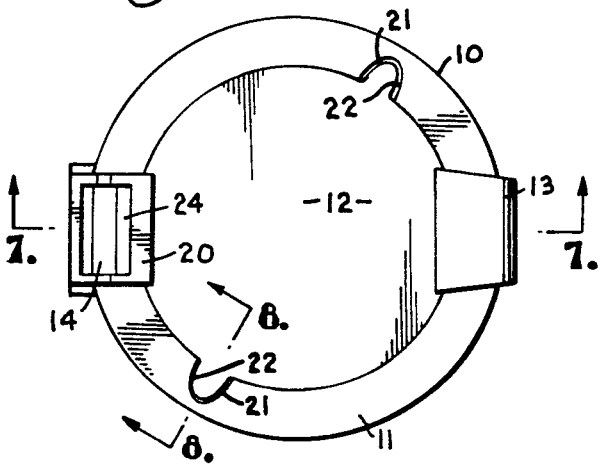
Fig. 6.
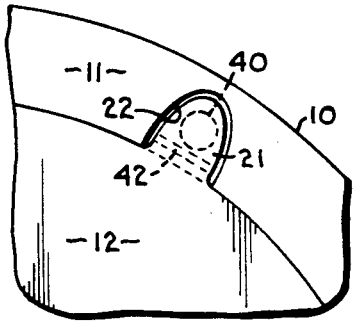
Fig. 7.
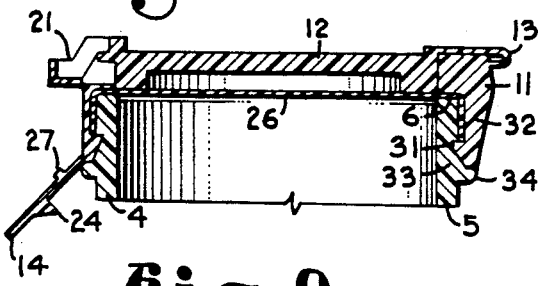
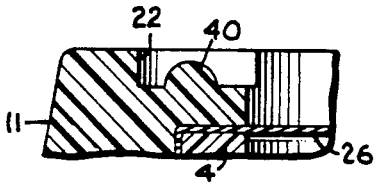
Fig. 8.
Fig. 9.
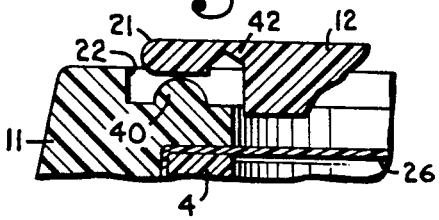
Fig. 10.
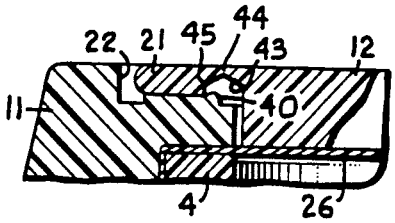
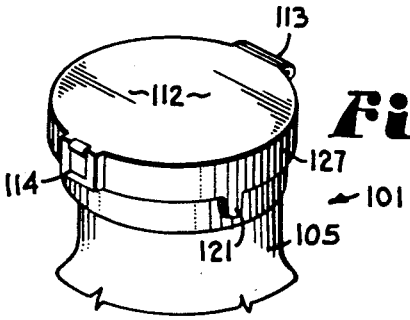
Fig. 12.
Fig. 11.
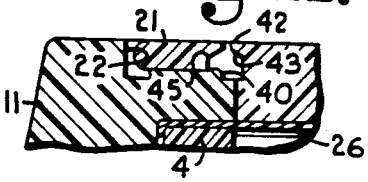

TAMPER-PROOF CONTAINER

BACKGROUND OF THE INVENTION

This invention relates to a tamper-proof container for "over-the-counter" drugs, foodstuffs or the like.

Recent, widely publicized instances of tampering with over-the-counter drugs have increased the need for tamper-evident and essentially tamper-proof containers for such drugs. In some of these cases, deaths have resulted from the introduction of poison into the drugs. The resulting adverse publicity and product liability concerns have caused drug and container manufacturers to conduct extensive research in the attempt to produce a fool-proof tamper-evident container.

The typical approach has been to adhere a tamper-evident foil or paper seal over the mouth of the container so that the seal must be broken to reach the container contents. The consumer, upon observing the broken seal, will know that the container is suspect. This approach has been only partially successful. The foil seal can sometimes be removed intact by degrading the adhesive rather than the seal itself or by peeling the seal from the container. The drugs can then be tampered with and the seal then replaced without alerting the consumer. Alternatively, appropriate replacement seal material can be used to reseal the container, again without alerting the consumer.

Another approach has been to snap a tightly fitting two-part lid over the container, with the parts separable from each other via a frangible connection, a tear strip or the like. These containers can usually be reopened by a determined tamperer by removing the entire two-part lid from the container and replacing it. Heating either the container or the lid sometimes allows just enough tolerance for the lid to be removed intact from the container, leaving no evidence of tampering. Tamper evident seals are also often used in conjunction with these two-part lids, but the problems with these have been mentioned above.

Another approach has been to use an internal label which changes color upon exposure to air, but this approach is expensive since the labels themselves are costly and the containers must be sealed in an air evacuated chamber. Furthermore, it is possible to replace the labels in the same fashion, or to open the container in an air evacuated chamber.

It is clear then, that the need exists for a safe, inexpensive, simple and reliable container for over-the-counter drugs and the like which gives positive evidence of tampering. Such a container must also not be subject to defeat by a tamperer, i.e. it must be tamper-proof.

SUMMARY OF THE INVENTION

The present invention is a tamper-proof container for over-the-counter drugs or the like.

The container comprises a integrally molded plastic bottle which is preferably cylindrical in shape. Near the top of the bottle, the cylinder tapers to a narrow neck, the neck including a rounded annular lip which extends completely around the neck. Above the annular lip is a relatively deep annular angled indentation which tapers inward at a relatively shallow angle to a point and then extends outward at an approximately 90 degree angle so that the neck resumes approximately the same circumference above the indentation as it was below the annular lip.

The bottle neck ends in a top circular mouth. A molded two-part closure includes a cap ring which terminates in an annular, angled projection which snaps over the top of the bottle neck and fits snugly into the annular angled indentation in the bottle. A hinged cap is connected to the cap ring and is ultrasonically welded to the cap ring via "tamper tabs" molded into the cap ring and the cap. A tamper-evident seal made of paper, foil, etc., is adhered to the top of the bottle once it is filled and prior to snapping the cap ring onto the bottle. After the cap ring is snapped onto the bottle, the deep indentation in the bottle neck and the matching projection on the cap ring make it virtually impossible to remove the cap ring from the bottle. To insure that the container is tamper-proof, however, once the bottle is filled and the tamper-evident seal adhered to the top, the cap ring is snapped onto the bottle and can then be ultrasonically welded to the bottle to insure that it cannot be removed.

The combination of the tamper-evident seal, the ultrasonic welding of the cap ring to the bottle, and the ultrasonically welded "tamper tabs" between the cap and the cap ring result in a truly tamper-proof container.

OBJECTS AND ADVANTAGES OF THE INVENTION

The principal objects of the present invention are: to provide a tamper-proof container for over-the-counter drugs and the like; to provide such a container which is inexpensive to produce, yet extremely reliable; to provide such a container which has a tamper-proof seal adhered to the top; to provide such a container which has a relatively deep annular angled indentation to which a cap ring with a matching angled projection can be attached, resulting in a snug snap fit; to provide such a container in which the cap ring, once snapped into place on the container, can be ultrasonically welded to the container, thus creating a truly tamper evident connection between the cap ring and the bottle; to provide such a container which has a hinged cap integrally molded to the cap ring; to provide such a container which has a plurality of "tamper tabs" molded onto the cap ring or the cap which can be ultrasonically welded, thus creating a tamper evident connection between the cap and the cap ring; to provide such a container which is entirely constructed of molded plastic; and to provide such a container which is particularly well adapted for its intended use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is an enlarged, top plan view of the two-part closure, with the hinged cap closed.

FIG. 6 is an enlarged and fragmentary top plan view of a portion of the container closure, illustrating a "tamper tab" node in phantom lines.

FIG. 7 is an enlarged and fragmentary cross-sectional view of the bottle top and closure, taken along line 7—7 of FIG. 5 with the hinged cap closed.

FIG. 8 is an enlarged and fragmentary cross-sectional view of a portion of the cap ring of the closure, taken along line 8—8 of FIG. 5, and illustrating one of the "tamper tab" nodes.

FIG. 9 is an enlarged and fragmentary cross-sectional view of a portion of the closure, also taken along line 8—8 of FIG. 5, and showing the hinged cap being closed onto the cap ring at the tamper tab location during assembly and prior to welding of a tamper tap to the cap ring.

FIG. 10 is an enlarged and fragmentary cross-sectional view of a portion of the closure, again taken along line 8—8 of FIG. 5, and illustrating the tamper tab after ultrasonic welding.

FIG. 11 is an enlarged and fragmentary cross-sectional view of a portion of the closure, again taken along line 8—8 of FIG. 5, and illustrating the frangible break line severed after the initial removal of the hinged cap.

FIG. 12 is a fragmentary perspective view of another embodiment of the tamper-proof container in accordance with the present invention.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
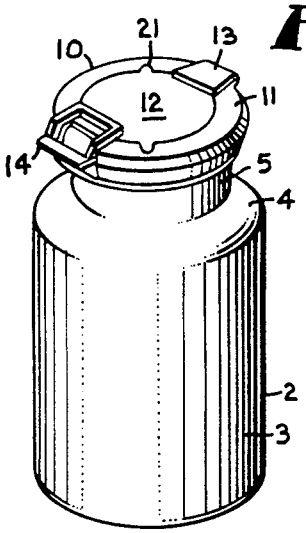
FIG. 1 is a perspective view of a fully assembled tamper-proof container in accordance with the present invention.

Referring to FIG. 1, there is shown a tamper-proof container 1 in accordance with the present invention. The container 1 comprises a generally cylindrical bottle 2 which has a relatively large diameter bottom portion 3, a tapered portion 4, and a relatively small diameter neck portion 5 terminating at an upper end thereof in an opening or mouth 6.

A two-part closure 10 comprises a cap ring 11, a hinged cap 12, a hinge 13, and a tongue or latch mechanism 14. The closure 10 is better illustrated in FIG. 2.

Figure 2:
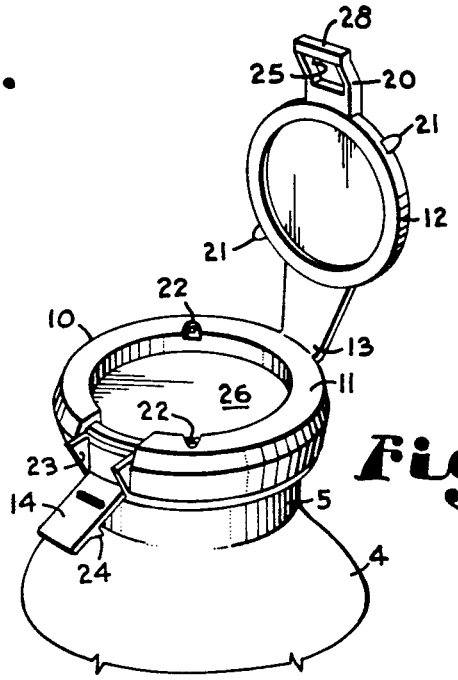
FIG. 2 is an enlarged and fragmentary perspective view of the container, illustrating a bottle top and a two-part closure thereof, with a hinged cap open.
Figure 4:
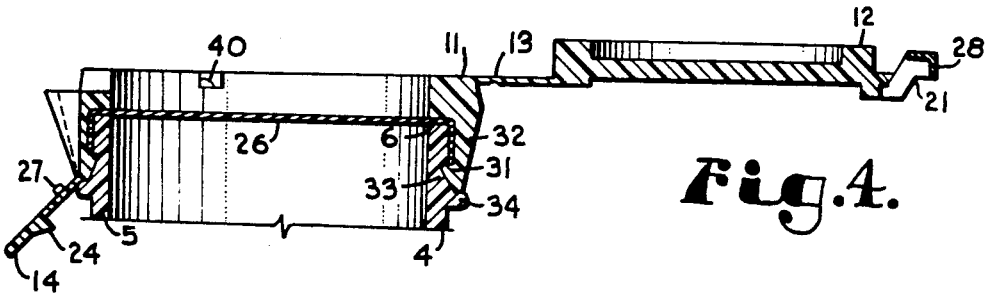
FIG. 4 is an enlarged and fragmentary cross-sectional view of the bottle top and closure, taken along line 4—4 of FIG. 3.

FIG. 2 shows the hinged cap 12 and the latch 14 in an open relationship and prior to final assembly. The cap 12 has a latch portion 20 and two "tamper tab" projections 21 integrally molded therewith. The projections 21 mate with matching depressions 22 in the cap ring 11 when the cap 12 is closed. The latch 14 is molded into the cap ring 11 and is adapted to be hinged upward between two ledges 23, also molded into the cap ring 11. When the latch 14 is in an upward position, such as is seen in FIG. 1 and, the cap 12 is closed, a recess 25 in the latch portion 20 receives the latch 14 and a projection 24 on the latch 14 snaps over a bar 28 on the cap 12 to securely fasten the cap 12 onto the cap ring 11 in a "hand to open" configuration The latch 14 can, subsequent to use, also be moved to an "easy open" position such as is seen in FIG. 4. Such a latch is further described in applicant's U.S. Pat. Nos. 4,809,874 and 4,925,041. This type of latch is merely illustrative, however, and it should be clear that any suitable latching mechanism could be used with the tamper-proof container of the present invention. A tamper-evident seal 26 made of paper or foil is adhered over the mouth of the bottle 2 after it is filled and prior to the placement of the closure 10 on the bottle 2. Such a procedure permanently locks the periphery of the seal 26 under the cap ring 11, even when the center of the seal 26 is removed or broken to identify when the seal 26 has been broken. Also, after the ring 11 is placed over the seal 26 and locked on the bottle neck portion 5, a new seal cannot be placed under the ring 11 after the old seal 26 is broken.

Figure 3:
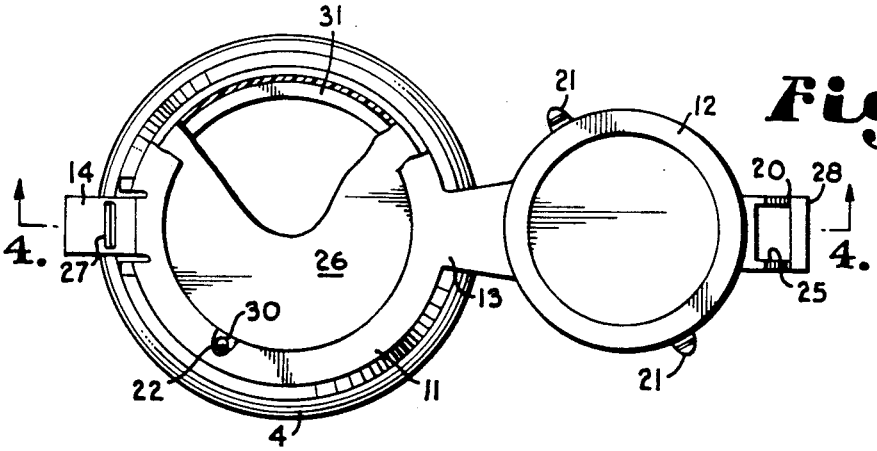
FIG. 3 is an enlarged, top plan view of the container, with the hinged cap open and a tamper-proof seal and a cap ring partially cut away to illustrate a snap connection between the cap ring and the bottle.

Referring to FIG. 3, the top of the closure 10 is shown with the cap ring 11, the seal 26, and the topmost portion of the bottle neck 5 shown partially cut away to reveal the seating mechanism between the cap ring 11 and the bottle neck 5. Looking at FIG. 4 in conjunction with FIG. 3, the cap ring 11 has an annular extension 32 which terminates in an angled or hook-shaped end portion 31. The bottle neck 5 has a rounded annular ring 34 molded therein with an annular sharply angled depression 33 just above the ring 34. Once the bottle 2 is filled, the tamper-evident seal 26 is adhered to the mouth of the bottle 2. The cap ring 11 is then snapped over the mouth of the bottle 2 with the angled end portion 31 of the cap ring extension 32 engaging the sharply angled depression 33 in the bottle neck 5. The hinged cap 12 is then folded over the top of the cap ring 11, with the recess 25 in the latch portion 20 engaging the projection 24 in the folded mechanism 14 which has been folded upward. The container is then ready to be sealed, as will be explained below with reference to FIGS. 5-11.

FIG. 5 illustrates the closure 10 with the hinged cap 12 folded onto the cap ring 11 with the tamper tab projections 21 intact. The latch 14 engages and passes through the surrounding latch portion 20 in a bayonet manner, as is further explained above.

FIGS. 6 and 8 show a tamper tab welding node 40 (also shown in FIG. 4) within the depression 22 in the cap ring 11, with FIG. 8 being a cross-sectional view along the line 8—8 in FIG. 5. The node 40 is shown in phantom lines in FIG. 6 under the projection 21 of the cap 12. As shown in FIG. 5, there are two of these nodes 40 each associated with corresponding mating projections 21 of the cap 12 and aligned to be positioned at or within the depressions 22 in the cap ring 11 when the cap 12 is closed.

FIG. 9 shows a fragmentary view of the cap 12 being closed with the projection 21 entering the depression 22 in the cap ring 11 and overlying the welding node 40. Once the latch mechanism 14 is snapped into cap latch position 20, the closure 10 is ready to be ultrasonically welded. An ultrasonic welder (not illustrated) heats the nodes 40 and the projections 21, causing them to fuse along a sealed seam 46, as illustrated in FIG. 10, also a cross-sectional view along the line 8—8 in FIG. 5. The node 40 is an energy director, acting to direct ultrasonic energy from the welder to fuse the projections 21 and the depressions 22 together. The closure 10 is preferably ultrasonically welded to the bottle neck 5 in the same manner by fusing portions of the annular angled projection 31 in the cap ring 11 to the annular angled depression 33 in the bottle neck 5. This insures that the closure 10 cannot be removed from the bottle 2 without partially destroying both the closure 10 and bottle 2.

The cap 12 is connected to the tamper tab projections 21 via relatively narrow frangible tear regions 42, as illustrated in FIGS. 9 and 10. The tear regions 42 are formed between the cap 12 and the projections 21 by molding a plurality of sharp angles 43, 44, and 45 (see FIG. 10) on the underneath side of a connecting bridge between them. After the projections 21 and the nodes 40 are ultrasonically welded, as shown in FIG. 10, the cap 12 can only be opened by rupturing the tear regions 42, as shown in FIG. 11 or by effectively destroying the closure 10 both of which provide quick and visible evidence to a user that the container 1 has been previously opened.

FIG. 7 illustrates the cap 12 closed onto the cap ring 11, but with the latch mechanism 14 folded downward. This position defeats the childproof feature of the latch, resulting in an easily opened configuration for adults and would normally be utilized only after the product was purchased and after the buyer made a conscious decision as to whether the closure 10 should be "easy opening" or "childproof". FIG. 7 also illustrates a linear flange 27 which is molded into the latch mechanism 14. The flange 14 is sized and positioned to mesh with the annular angled depression 33 in the bottle 2 when the latch mechanism 14 is hinged upward. This meshing acts to strengthen and secure the latch 14. Again, this latching mechanism is described with more particularity in applicant's U.S. Pat. Nos. 4,809,874 and 4,925,041.

FIG. 12 illustrates another embodiment of a tamper-proof container 101 with a plastic bottle 105. This embodiment differs from the container 1 in FIGS. 1–11 in that a hinged cap 112 completely covers a cap ring 111. Tamper tab projections 121 are molded onto overlapping sides 127 of the cap 112. The cap 112 also is secured to the cap ring 11 via a simple spring latch 114. This embodiment cannot be made "childproof". The placement of the tamper tab projections 121 on the side of the cap 112 has the benefit that a single ultrasonic welding horn ca weld both the cap 112 to the cap ring and the cap ring to the bottle neck 105 without changing positions and the welding at the shown projection 121 welds the ring 111 to the underlying bottle 105.

The entire tamper-proof container 1 can be constructed of low cost molded plastic. While the tamper-proof container 1 has been illustrated as cylindrical, it should be apparent that an desired shape and configuration could be used. The tamper tab nodes 40 have been illustrated as being molded as part of the cap ring 11, but they can be just as effectively molded as part of the cap 12 and may be of other shapes than shown, such as conical. While the annular depression 33 in the bottle neck 5 and the annular projection 31 in the cap ring 11 have been illustrated as angled, they can be rounded as well to provide a more suitable energy director for ultrasonically welding the cap ring 11 to the bottle neck 5. The cap 11 has been described as being welded to the cap ring 12 after the bottle 2 is filled and sealed, however, the closure 10 could be preassembled by welding the cap 12 to the cap ring 11 prior to its placement on the bottle 2.

It is likewise foreseen that the tamper indicating means of the present invention including the frangible tabs and the seal locked beneath the closure can both or individually be used with a wide variety of closures, including but not limited to non-hinged caps, caps having only a portion of the top thereof that opens which can be both hinged or non-hinged, aerosol nozzle covering caps, and the like.

Likewise, it is foreseen that the tamper tabs could initially be joined to either the cap (first and second embodiment) or the ring (second embodiment). Where the ring is not used with a foil seal or the like locked thereunder, the ring may also be an integral part of the container.

It is also foreseen that alternative "welding" means may be utilized other than ultrasonic welding to join the tamper tabs to the cap or ring such as high strength glue, heating or the like. Likewise, although use of the invention has been discussed extensively with over-the-counter-type drug products, it is foreseen that the invention may be utilized for other types of products where it is important for a user to know if the package has been previously opened, such as liquid drinks or foods.

It is to be understood that while certain forms of the present invention have been illustrated and described herein, it is not to be limited to the specific forms or arrangement of parts described and shown.

What is claimed and desired to be secured by Letters Patent is as follows:

1. A tamper evident container for over-the-counter drugs or the like, the container comprising:

(a) a contents holding portion terminating in a mouth;

(b) a two part closure including a cap ring and a cap, said cap ring including securing means to substantially non-removably secure said cap ring about said mouth;

(c) a tamper tab projection formed to a first of said cap and said ring by a frangible tear region prior to initial opening of said closure; said tamper tab projection mating with a tamper tab receiving region on a second of said cap and said ring when said cap is closed and prior to the initial opening of said closure; and (d) said tamper tab projection being connected to said receiving region by welding means such that said tamper tab projection is fixedly secured to said tamper tab receiving region such that said frangible tear region must be ruptured to open said container.

2. The container according to claim 1, wherein:

(a) said cap is hinged to said ring.

3. The container according to claim 1, wherein:

(a) said tamper tab projection is connected to said cap by said frangible tear region.

4. The container according to claim 1, wherein:

(a) said contents holding portion has locking means about said mouth that snappingly receives said ring such that said ring is substantially non-removable from said contents receiving portion without destruction of at least one of said ring and said contents receiving portion.

5. The container according to claim 4, wherein:

(a) said contents receiving portion is a bottle having an annular angled depression below said mouth; and (b) said cap ring has a matching annular angled projection sized and positioned to mate with said annular angled depression when said cap ring is fitted over said mouth and to securely retain said cap ring on said bottle.

6. The container according to claim 4, wherein:
(a) said cap ring is originally separate from said contents holding portion and both are ultrasonically welded together prior to usage 7. The container according to claim 6, wherein:
(a) A tamper evident seal is adhered over said mouth, said seal being covered by said two part closure such that a periphery of said seal is fixedly and non-removably held beneath said ring.

8. The container according to claim 1, wherein:
(a) a tamper evident seal is adhered over said mouth, said seal being covered by said two part closure when said cap ring is fitted to said bottle.

9. The container according to claim 1, wherein:
(a) there are two of said tamper tab projections in spaced relationship to one another;
(b) said welding means is a welder; and
(c) an energy directing node is molded into each of said tamper tab receiving regions to direct ultrasonic energy from said welder.

10. The container according to claim 1, wherein:
(a) said cap includes a side that overlaps said ring and said tamper tab projection is connected to said cap side.

11. A tamper-evident container for over-the-counter drugs or the like, the container comprising:
(a) a bottle which terminates in a mouth;
(b) a two-part closure including a cap ring and a cap; said cap being connected to a tamper tab projection by a frangible tear region, said tamper tab projection mating with a matching tamper tab depression in said cap ring when said cap is closed;
(c) said cap being connected to said cap ring by ultrasonically welding said tamper tab projection to said tamper tab depression so that said frangible tear region must be ruptured to open said container;
(d) said bottle having a annular angled depression below said mouth;
(e) said cap ring having a matching annular angled projection sized and positioned to mate with said angled depression when said cap ring is fitted over said mouth and to securely retain said cap ring on said bottle;
(f) said bottle and said cap ring being ultrasonically welded to join said annular angled depression to said annular angled projection so that the welds must be broken to remove said cap ring from said bottle; and
(g) a tamper-evident seal adhered over the mouth of said bottle, said seal being covered by said two-part closure when said cap ring is placed onto said bottle.

12. A container according to claim 11, wherein:
(a) there are two of said tamper tab projections and two of said tamper tab depressions; one of each of said depressions being located to receive a respective tamper tab projection with said projections located in diagonal positions with respect to each other on opposite sides of said cap; and
(b) an energy directing node is molded into each of said tamper tab depressions to direct ultrasonic energy from a welder.

13. A tamper-evident container for over-the-counter drugs or the like, the container comprising:
(a) a bottle terminating in a mouth;
(b) a two part closure including a cap ring and a cap; said ring snugly fitting over said bottle mouth;
(c) said bottle having a relatively deep annular angled depression below said mouth;
(d) said cap ring having a matching annular angled projection sized and positioned to mate with said annular angled depression when said cap ring is fitted over said mouth to securely retain said cap ring on said bottle;
(e) said cap is connected to at least one tamper tab projection via a frangible tear region prior to initial usage; said tamper tab projection mating with a matching tamper tab receiving region on said cap ring when said cap is closed; and
(f) said cap is connected to said cap ring by ultrasonically welding said tamper tab projection to said tamper tab receiving region so that said frangible tear region must be ruptured to open said container.

14. The container according to claim 13, wherein:
(a) there are two of said tamper tab projections and said tamper tab receiving regions with each of said regions being a depression in said ring; and
(b) an energy directing need is molded into each of said tamper tab depressions to direct ultrasonic energy from a welder.

15. The container according to claim 13 including:
(a) a seal initially entirely covering said mouth and having a periphery thereof secured beneath said ring such that said seal cannot be opened without first opening said closure and such that said periphery remains under said ring when said seal is opened as evidence of such opening.

* * * * *